United States Patent [19]

Wang

[11] Patent Number: 4,712,795

[45] Date of Patent: Dec. 15, 1987

[54] GAME RACKET

[75] Inventor: An Wang, Bedford Rd., Lincoln, Mass. 01730

[73] Assignee: An Wang, Lincoln, Mass.

[21] Appl. No.: 868,836

[22] Filed: May 29, 1986

[51] Int. Cl.[4] ..... A63B 49/00

[52] U.S. Cl. ..... 273/73 R

[58] Field of Search ..... 273/67 R, 73 R, 73 C, 273/73 D, 73 E, 73 J, 75, 29 A, 29 B

[56] References Cited

U.S. PATENT DOCUMENTS

| | | | |
|---|---|---|---|
| 1,917,236 | 7/1933 | Bloomstrand | 273/73 J |
| 4,006,896 | 2/1977 | Soldavihi | 273/73 J |
| 4,326,714 | 4/1982 | Novack | 273/73 C |
| 4,593,905 | 6/1986 | Abel | 273/73 D |

OTHER PUBLICATIONS

Tennis Magazine; "What's Ahead for Racquets in 1986"; Dec. 1985, (copy in A.V. 334).

Popular Science; "Wind-Tunnel-Tuned Tennis Racket"; Sep. 1985, p. 110, (copy in A.V. 334).

Sports Illustrated; "The Arthur Ashe Competition Racket"; May 16, 1977, p. 55, (copy in A.V. 334).

*Primary Examiner*—Anton O. Oechsle

*Assistant Examiner*—Matthew L. Schneider

*Attorney, Agent, or Firm*—Michael H. Shanahan

[57] ABSTRACT

At least one mark is provided on a tennis racket. The distance between the mark and an end or edge of the racket defines a measurement length which is equal to the difference between the 36" height of the net and the length of the racket. The height of the net can be verified by the combined height of the racket and the measurement length. Three marks may be provided on the strings of the racket head to define the measurement length between each side edge of the racket head and the end of the racket head. Also, a mark may be provided on the handle of the racket.

13 Claims, 3 Drawing Figures

GAME RACKET

BACKGROUND

The present invention relates to rackets used in net games such as tennis and badminton. According to the rules of the International Lawn Tennis Federation, the height of a tennis net should be three feet at the center. Typically, the net is held down at the center to the 36" height by a strap which is secured to the ground. The strap is adjustable so that the height can be adjusted.

Standard tennis rackets are 27" long and 9" wide across the head of the racket. Thus, a common approach to assuring that the tennis net is at the proper height has been to stand the racket next to the net to measure 27" and then turn the racket on its side with the lower edge at the measured 27". If the net is at the proper height, the upper edge of the racket is then at the same height as the net. In recent years, tennis rackets of many different heights and widths have been introduced. Such rackets to not allow for the conventional approach to verifying the net height used by tennis players.

Beyond having a yard stick at the court, other approaches to verifying the height of the tennis net have been suggested. In U.S. Pat. No. 3,549,146 to Davis, a rod is pivotally mounted to the court where the center strap is fixed to the ground. The rod is 36" tall when lifted to a vertical position and thus provides a rule for the net height. In play, the rod is laid horizontally beneath the net. Other approaches to verifying the height of the net include the use of a chain such as that illustrated in U.S. Pat. No. Des. 249,336 to Webb, or a chain fixed to the end of a racket by which the racket is suspended from the top band of the net as illustrated in U.S. Pat. No. 4,205,840 to Blevins. In yet another approach, illustrated in U.S. Pat. No. 1,351,066 to Robinson, height indications are provided at the buckle of the net center strap.

DISCLOSURE OF THE INVENTION

In accorance of the present invention a conventional racket is simply and inexpensively modified to provide an indication of the height of the net. At least one mark is provided on the racket to define a measurement length. The racket can be positioned next to the net in a vertical orientation to note a first length which is less than the height of the net, such as the overall height of the racket, and by then positioning the racket such that the measurement length is added to the first length to verify the height of the net. To allow for measurement from either side edge of the racket head or from the end of the racket head, three marks may be provided on the racket strings. In addition, or alternatively, a mark may be placed on the handle.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DESCRIPTION OF PREFERRED EMBODIMENTS

Figure 1:
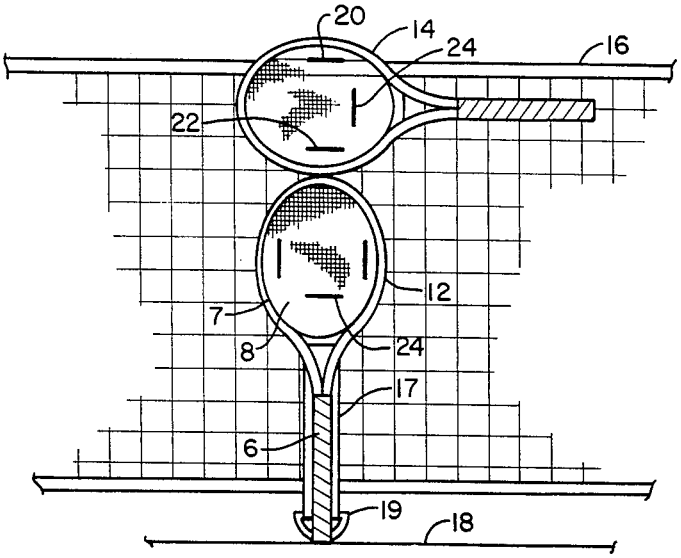
FIG. 1 is an illustration of two rackets embodying the present invention used to measure the height of a net

FIG. 1 illustrates two rackets 12 and 14 in position next to a tennis set 16. The rackets are, but for marks provided in accordance with the present invention, conventional tennis rackets. Each includes a handle 6 and a head 7 which supports strings 8. The net 16 is held to the proper height by a strap 17 wrapped over the upper edge of the net and secured to the court 18 by a ring 19 and a connection not shown.

Figure 3:
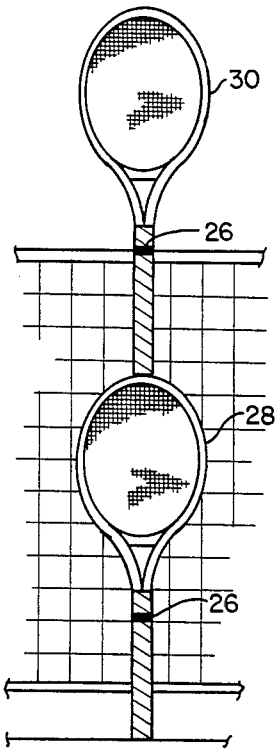
FIG. 3 is an illustration similar to FIGS. 1 and 2 but with the measurement mark on the handle of the racket.
Figure 2:
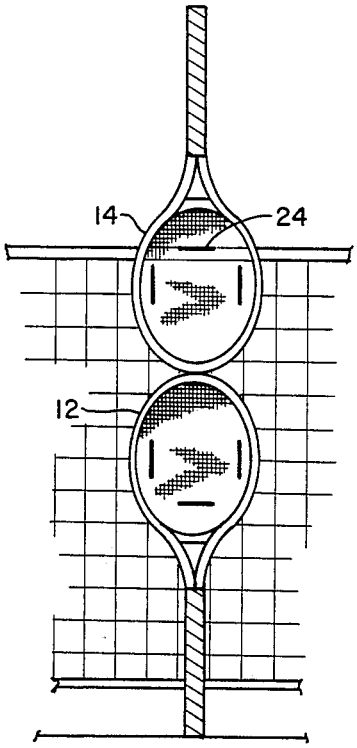
FIG. 2 is a view similar to FIG. 1 but illustrating the second racket in a vertical orientation.

The height at the center of the net from the court 18 should be 36". To verify that height, the racket 12 is placed in a vertical orientation on the court adjacent to the net. The height of the racket defines a first length less than the height of the net. The difference between the proper net height and the height of the racket, a measurement length, is defined by the distance between a mark 20 on the racket and the side edge of the racket head. If a like racket 14 is available, that racket can be placed on the racket 12 as illustrated in FIG. 1, and the proper net height is indicated by the mark 20. A similar mark 22 may be provided so that the opposite side edge of the racket head can be positioned against the racket 12. Further, a third mark 24 may be provided to define a measurment length between that mark and the end of the racket so that the measurement can be obtained as illustrated in FIG. 2 with the two rackets head to head. Alernatively, or additionally, the mark may be provided on the hahdle as at 26 on the rackets 28 and 30 in FIG. 3, so that the measurement distance is between that mark and the end of the racket handle.

In each illustration, two like rackets are illustrated. It should be recognized that, if only one suitably marked racket is on hand, the first length defined by the height of the racket may be noted by simply holding one's finger at that height and then moving the same racket to one of the positions illustrated in FIGS. 1–3 to complete the measurement using the measurement length defined by the mark.

As an alternative, to provide a universal mark by which two rackets of different sizes can be used together to make the measurement, the mark may be placed 18 inches from one end of the racket. Then, a second racket having a similar 18 inch mark can be held against the first racket in a like vertical orientation but with its end at the height of the mark of the first racket.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A racket and net for playing a game, the net to be of a predetermined net height, the racket comprising a head supporting strings and handle extending from the head, the head having a free end located away from the handle and the handle having a free end located away from the head, the racket having at least one prominent, linear mark thereon which is parallel to or perpendicular to the handle axis and which is isolated from like marks so as not to be confused with other like marks, the mark defining, relative to an end or side edge of the racket, a prominent measurement length which runs perpendicular to the linear mark, the measurement length being equal to the difference between the predetermined net height and the length of the racket or a like prominent measurement length determinable from a linear mark on the racket.

2. A racket and net as claimed in claim 1 for tennis wherein the mark defines a measurement length equal to the difference between 36" and a length determinable from the racket.

3. A racket and net as claimed in claim 1 wherein the mark is positioned on the handle and the measurement length is the distance between the mark and the free end of the handle.

4. A racket and net as claimed in claim 1 wherein the mark is on the strings of the racket and the measurement length is the distance between the mark and the free end or a side edge of the racket head.

5. A racket and net as claimed in claim 4 comprising at least two marks, each positioned a distance equal to the measurement length from a side edge of the racket head.

6. A racket and net as claimed in claim 5 further comprising a mark positioned a distance equal to the measurement length from the free end of the racket head.

7. A racket and net as claimed in claim 4 further comprising a mark positioned a distance equal to the measurement length from the free end of the racket head.

8. A tennis racket for playing tennis, the racket comprising a head supporting strings and a handle extending from the head along a handle axis, the head having a free end located away from the handle and the handle having a free end located away from the head, the handle and head defining a racket length, the racket having at least one prominent, linear mark thereon which is parallel to or perpendicular to the handle axis and which is isolated from like marks so as not to be confused with other like marks, the mark defining, relative to an end or side edge of the racket, a measurement length which runs perpendicular to the linear mark, the measurement length being equal to the difference between 36" and the racket length.

9. A racket as claimed in claim 8 wherein the mark is positioned on the handle and the measurement length is the distance between the mark and the free end of the handle.

10. A racket as claimed in claim 8 wherein the mark is on the strings of the racket and the measurement length is the distance between the mark and the free end or a side edge of the racket head.

11. A racket as claimed in claim 10 comprising at least two marks, each positioned a distance equal to the measurement length from a side edge of the racket head.

12. A racket as claimed in claim 11 further comprising a mark positioned a distance equal to the measurement length from the free end of the handle.

13. A racket as claimed in claim 10 further comprising a mark positioned a distance equal to the measurment length from the free end of the racket head.

* * * * *